US006119342A

United States Patent [19]

Shima et al.

[11] Patent Number: 6,119,342

[45] **Date of Patent: *Sep. 19, 2000**

[54] METHOD OF PRODUCING A RECORD HEAD FOR AN ELECTROSTATIC INK JET RECORDER

[75] Inventors: Kazuo Shima; Junichi Suetsugu; Ryosuke Uematsu; Tadashi Mizoguchi; Hitoshi Minemoto; Hitoshi Takemoto; Yoshihiro Hagiwara; Toru Yakushiji, all of Niigata, Japan

[73] Assignee: NEC Corporation

[ * ] Notice: This patent issued on a continued prosecution application filed under 37 CFR 1.53(d), and is subject to the twenty year patent term provisions of 35 U.S.C. 154(a)(2).

[21] Appl. No.: 08/876,856

[22] Filed: Jun. 16, 1997

[30] Foreign Application Priority Data

Jun. 17, 1996 [JP] Japan ..... 8-155896

[51] Int. Cl.[7] ..... B41J 2/065; B11B 5/27

[52] U.S. Cl. ..... 29/890.1; 216/27; 347/55

[58] Field of Search ..... 29/890.1, 825, 29/25.35, 738; 347/55; 216/95, 27, 56

[56] References Cited

U.S. PATENT DOCUMENTS

| | | | |
|---|---|---|---|
| 4,411,731 | 10/1983 | Miller | 216/95 |
| 4,415,403 | 11/1983 | Bakewell | 216/27 |
| 4,920,363 | 4/1990 | Hack | 346/155 |
| 5,030,974 | 7/1991 | Tange . | |
| 5,148,595 | 9/1992 | Doggett et al. | 29/840 |
| 5,471,231 | 11/1995 | Hiraishi et al. | 347/68 |
| 5,607,535 | 3/1997 | Tsukada et al. | 29/25.35 |
| 5,610,645 | 3/1997 | Moore et al. | 347/93 |
| 5,646,095 | 7/1997 | Edelloth et al. | 216/95 |
| 5,680,702 | 10/1997 | Kataoka | 29/890.1 |
| 5,781,994 | 7/1998 | Fouillet et al. | 29/890.1 |
| 5,801,730 | 9/1998 | Shima et al. | 347/55 |
| 5,802,717 | 8/1998 | Murakami | 29/890.1 |

FOREIGN PATENT DOCUMENTS

| | | | |
|---|---|---|---|
| 50-85118 | 12/1948 | Japan . | |
| 59-201866 | 11/1984 | Japan . | |
| 60-72735 | 4/1985 | Japan . | |
| 61-286150 | 12/1986 | Japan | 29/890.1 |
| 62-276887 | 12/1987 | Japan | 29/25.35 |
| 2-209262 | 8/1990 | Japan . | |
| 4-241955 | 8/1992 | Japan . | |
| 404279354 | 10/1992 | Japan | 29/890.1 |
| 2035908 | 6/1980 | United Kingdom . | |
| 93/11866 | 6/1993 | WIPO . | |

OTHER PUBLICATIONS

Fabrication of Ink–Jet Head Components by Through–Mask Electrochemical Micromachining, IBM Technical Disclosure Bulletin, vol. 35, No. 1B, pp. 453–454, Jun. 1992.

*Primary Examiner*—Lee Young
*Assistant Examiner*—A. Dexter Tugbang
*Attorney, Agent, or Firm*—Ostrolenk, Faber, Gerb & Soffen, LLP

[57] ABSTRACT

A record head for an electrostatic ink jet recorder includes a head chip implemented as a laminate of alternating flat conductors and flat insulators and etched by an etching liquid reactive only to the material of the insulators. The conductors readily turn out ridges protruding from the head chip and having a high aspect ratio. The ridges each serve as an ejection electrode.

3 Claims, 3 Drawing Sheets

METHOD OF PRODUCING A RECORD HEAD FOR AN ELECTROSTATIC INK JET RECORDER

BACKGROUND OF THE INVENTION

The present invention relates to a recorder of the type recording an image on a medium by depositing toner on the medium and, more particularly, to a method of producing a record head for an electrostatic ink jet recorder.

Non-impact recording schemes are attracting increasing attention because they produce only a negligible degree of noise during operation. Among them, an ink jet recording scheme is capable of recording an image directly on a medium at a high speed despite its simple configuration, and practicable even with plain papers. Various kinds of ink jet recording systems heretofore proposed include one using ink consisting of a carrier liquid and toner particles dispersed in the liquid. In this system, a voltage is selectively applied between needle-like ejection electrodes and a counter electrode facing the ejection electrodes and located behind a sheet or recording medium. The resulting electric field causes a coloring material contained in the ink to electrostatically fly toward the sheet, forming an image on the sheet. A record head for such a system includes a substrate on which ejection electrodes are formed independently of each other. Meniscus forming members each overlies one of the ejection electrodes. A cover covers the meniscus forming members and has an ink inlet port and an ink outlet port. Fine ejection openings or slits are formed by the substrate, meniscus forming members, and cover. Ink introduced into the head via the ink inlet port forms meniscuses at the front ends or tips of the meniscus forming members.

The above conventional record head, however, has the following problems left unsolved. Because the meniscus forming members are implemented by a photoconductive resist, their thickness is limited to several tens of microns. Further, because the meniscus forming members are formed by photolithographic exposure and development, their front corner portions or ejection points are not sharp. These in combination prevent meniscuses formed thereon from having a stable shape.

Technologies relating to the present invention are taught in, e.g., WO 93/11866 and Japanese Patent Laid-Open Publication No. 4-241955.

SUMMARY OF THE INVENTION

It is therefore an object of the present invention to provide a method of producing a record head for an electrostatic ink jet recorder and capable of forming ridges for forming meniscuses with a high aspect ratio.

In an electrostatic ink jet recorder of the type applying an electric field to ink containing charged toner particles, and ejecting an ink drop due to the resulting Coulomb force acting on the toner particles to thereby form a dot on a recording medium, a method of producing a record head of the present invention has the steps of laminating together alternating plates of flat conductors each having a thickness of several tens of microns and flat insulators each having a thickness of several tens of microns, and etching the insulators by an etching liquid reactive only to the insulators. As a result, the conductors protrude from the record head, forming undulated surfaces.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

To better understand the present invention, brief reference will be made to a conventional record head of an electrostatic ink jet recorder, shown in FIGS. 1A–1C. Briefly, the recorder to be described uses ink consisting of a carrier liquid and toner particles dispersed in the liquid. A voltage is selectively applied between needle-like ejection electrodes and a counter electrode facing the ejection electrodes and located behind a sheet or recording medium. The resulting electric field causes a coloring material contained in the ink to electrostatically fly toward the sheet, forming an image on the sheet.

Figure 1A:
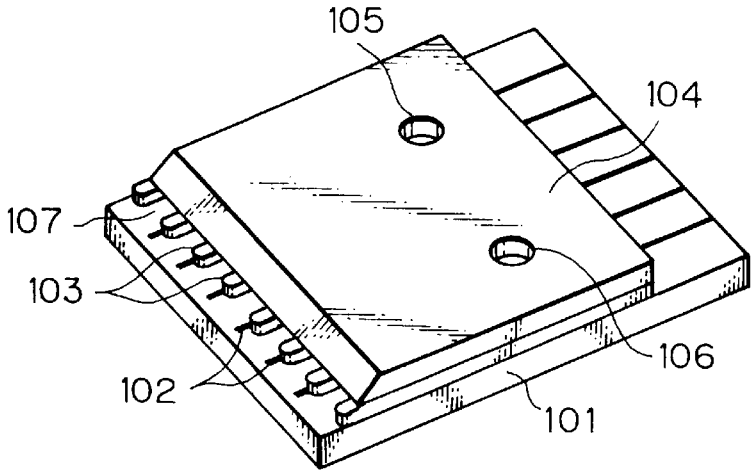
Fig. 1A PRIOR ART
FIG. 1A is an external perspective view showing a conventional record head for an electrostatic ink jet recorder.
Figure 1B:
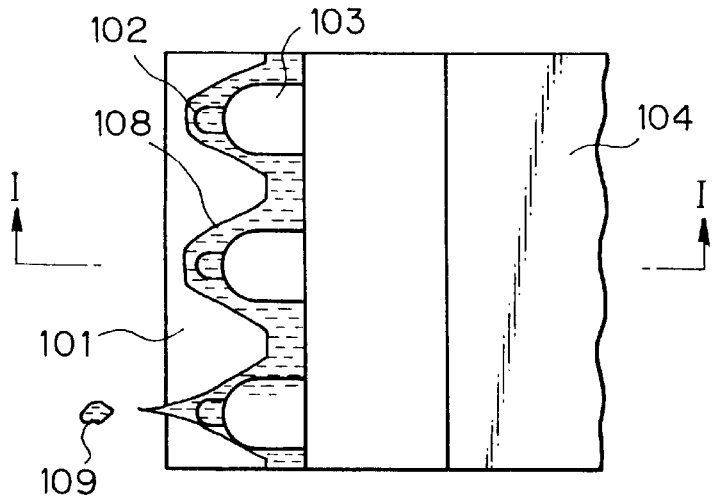
Fig. 1B PRIOR ART
FIG. 1B is a plan view showing the front end portion of the conventional record head.
Figure 1C:
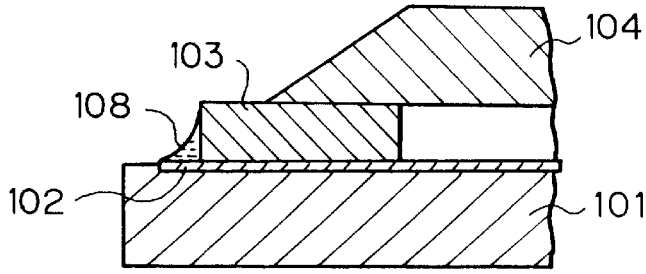
Fig. 1C PRIOR ART
FIG. 1C is a section along line I—I of FIG. 1B.

As shown in FIGS. 1A–1C, the record head includes a flat substrate 101 formed of an insulating material. A plurality of ejection electrodes 102 are formed on the surface of the substrate 101 at intervals corresponding to a desired resolution. To form the ejection electrodes 102, the entire surface of the substrate 101 is covered with Cu, Ni or similar conductive substance by sputtering, and then the conductive material is exposed and developed via a mask formed with a pattern representative of the electrodes 102. The electrodes 102 are independent of each other and connected to a driver, not shown, at one end thereof. During recording, a high pulse voltage is selectively applied to the electrodes 102. The surface of the substrate formed with the electrodes 102 is coated with an insulative coating material by spin coating, so that the electrodes 102 and ink are insulated from each other.

Meniscus forming members 103 each overlies the respective ejection electrode 102 on the substrate 101. To form the meniscus forming members 103, an insulative photoconductive resist is laminated or spin-coated on the substrate 101 over the electrodes 102, and then the resist is exposed and developed via a mask formed with a pattern representative of the members 103. A cover 104 is formed of an insulating material and mounted on the meniscus forming members 103 at a position recessed from the front ends of the members 103. An ink inlet port 105 and an ink outlet port 106 are formed in the cover 104, as illustrated. The substrate 101, cover 104 and nearby meniscus forming members 103 form a fine opening or slit 107. Ink fed via the inlet port 105 is routed through the slit 107 to the front ends of the meniscus forming members 103. In this condition, the members 103 each forms an ink meniscus 108 at the front end or tip thereof. In FIG. 1B, the reference numeral 109 designates a drop ejected from the head.

The conventional record head described above has some problems left unsolved, as follows. Because the meniscus forming members 103 are implemented by a photoconductive resist, their thickness is limited to several tens of microns. Further, because the members 103 are formed by photolithographic exposure and development, their front corner portions or ejection points are not sharp. These in combination prevent the meniscus from having a stable shape.

Figure 2:
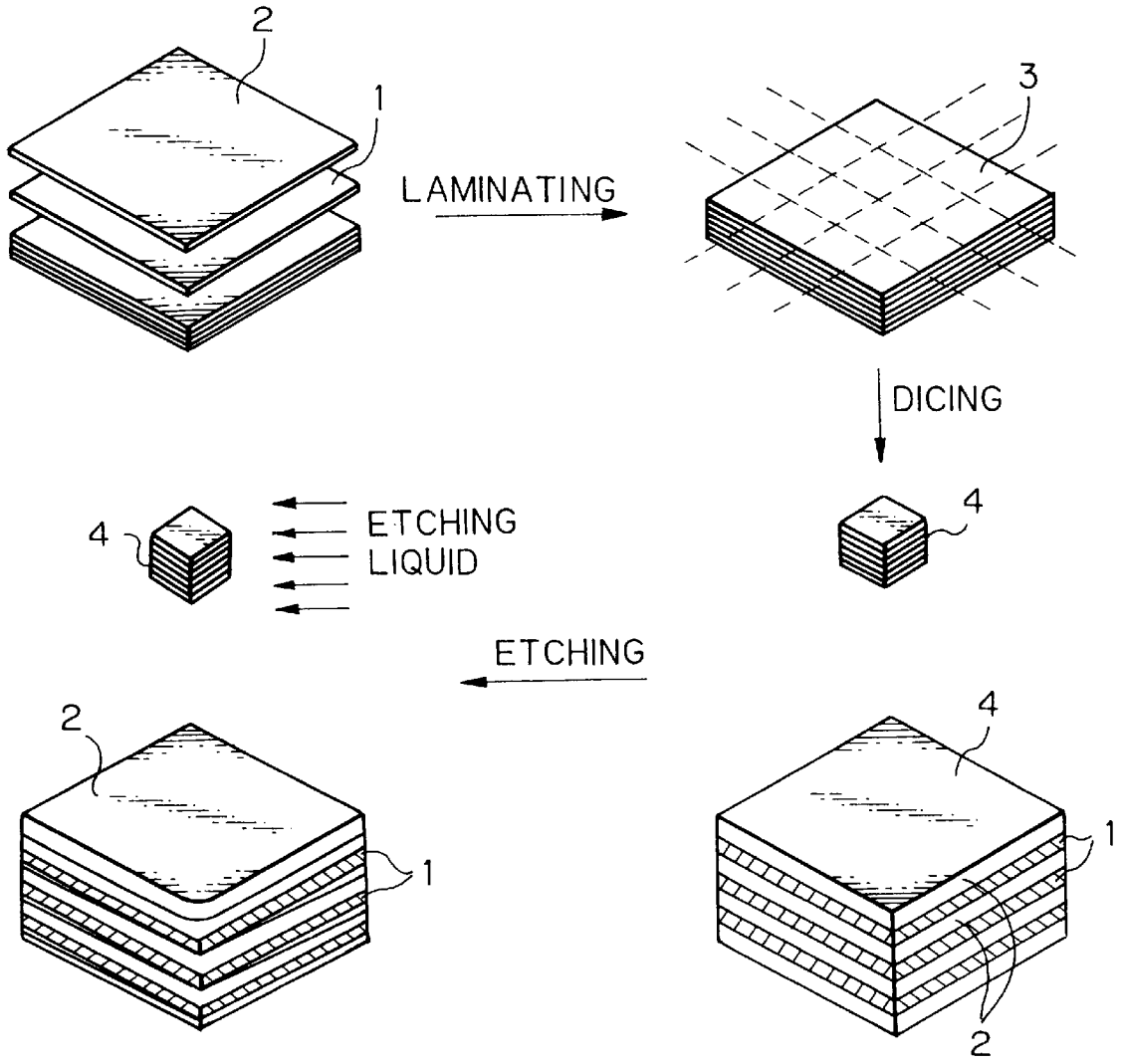
FIG. 2 shows a sequence of steps for producing a head chip included in a record head in accordance with the present invention.

Referring to FIG. 2, a method of producing a record head and embodying the present invention will be described. As shown, flat conductive plates (conductors) 1 and flat insulative plates (insulators) 2 are laminated alternately with each other, forming a base 3. The conductive plates 1 are formed of Ni, Cu or similar metal, and each has a thickness of several tens of microns. The insulative plates 2 are formed of, e.g., plastics. The thickness of each insulative plate 2 is selected such that the pitch of the conductive plates 1 corresponds to a desired resolution. For example, assume that the desired resolution is 300 dots per inch (dpi), and that each conductive plate 1 has a thickness t of 30 microns. Then, the pitch of the conductive plates 1 is 85 microns, and therefore the thickness of the insulative plates 2 is about 55 microns. The number of the conductive plates 1 is equal to the desired number of dots.

The base 3 is cut into head chips 4 by dicing. Each head chip 4 is a laminate of the conductive plates 1 and insulative plates 2 alternating with each other.

The individual head chip 4 is immersed, only for a preselected period of time, in an etching liquid reactive to the material of the insulative plates 2, but not reactive to the material of the conductive plates 1. As a result, the insulative plates 2 are etched to a desired depth, as measured from their surfaces. The resulting chip 4 has, when seen in a sectional view, an undulated surface on which the conductive plates 1 protrude in the form of ridges. In a cross-sectional view, the conductive ridges are seen as the peaks of the undulated profile. Because the material of the insulative plates 2 is etched at a given rate, it is possible to provide the above ridges with any desired aspect ratio by selecting a corresponding etching time.

Figure 3A:
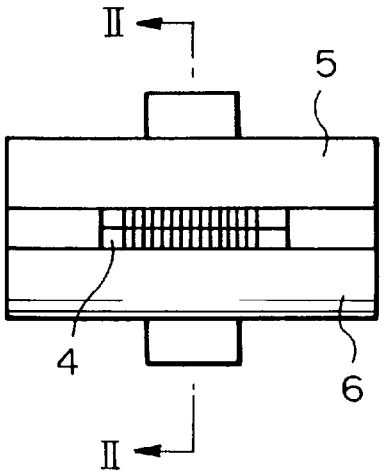
FIG. 3A is a front view of a record head including the head chip produced by the procedure of FIG. 2.
Figure 3B:
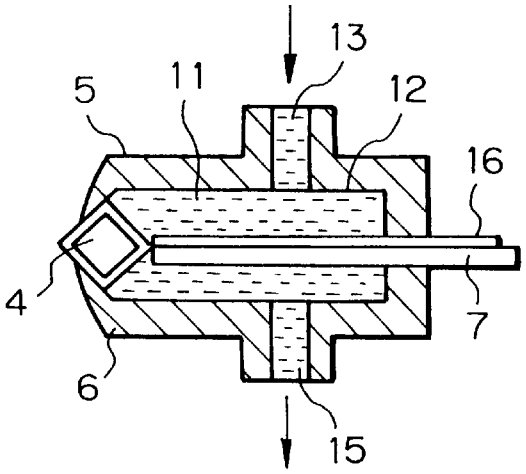
FIG. 3B is a section along line II—II of FIG. 3A.
Figure 4:
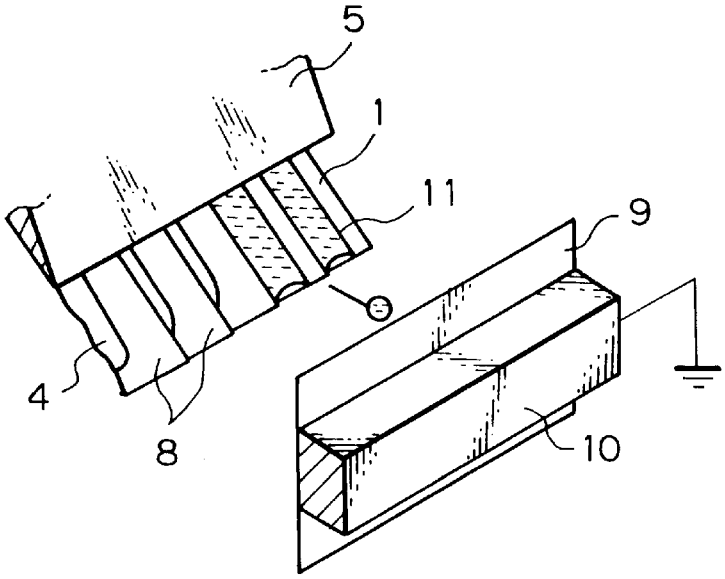
FIG. 4 is a fragmentary perspective view showing the front end portion of the record head shown in FIG. 3A.

Reference will be made to FIGS. 3A and 3B for describing a record head implemented by the head chip 4. The ejecting portion of the record head is shown in FIG. 4 in detail. As shown, the head is made up of the head chip 4, an upper cover 5, a lower cover 6, and a contact substrate 7. A counter electrode 10 faces ejection points 8 included in the head with the intermediary of a sheet or recording medium 9. The counter electrode 10 plays the role of a platen for conveying the sheet 9 at the same time.

The conductive plates 1 forming the ridges are used as ejection electrodes for desired dots at one of the corners where two undulated sides of the head chip 4 adjoin each other. Further, the corners of the conductive plates or ridges 1 are used as the ejection points 8 for the desired dots. Each recess or channel between nearby ridges plays the role of an ink passageway for allowing ink to flow while forming a meniscus around the associated ejection point 8.

The upper cover 5 is implemented as a molding of plastics or similar insulating material and disposed above the contact substrate 7. The cover 5 and substrate 7 form an upper chamber 12 in cooperation in order to hold ink 11 therein. An ink inlet 13 is formed in the top of the cover 5 in order to feed the ink 11 into the chamber 12. The ink inlet 13 is connected to an ink circulation pump and an ink tank by a tubing, although not shown specifically. A part of the cover 5 is disposed above the head chip 4 and covers the upper portion of the undulated surface at a position recessed from the ejection points 8.

The lower cover 6 is also implemented as a molding of plastics or similar insulating material and located below the contact substrate 7. The cover 6 and substrate 7 form a lower chamber 14 in cooperation in order to hold the ink 11 therein. An ink outlet 15 is formed in the bottom of the cover 6, so that the ink 11 flows out of the chamber 14 via the outlet 15. The ink outlet 15 is connected to the ink tank by a tubing, although not shown specifically. A part of the cover 6 is positioned below the head chip 4 and covers the lower portion of the undulated surface at a position recessed from the ejection points 8.

The contact substrate 7 is formed of an insulating material. Contact pads 16 and a conductor pattern are formed on the upper surface of the contact plate 7. The contact pads 16 are connected to a driver not shown. The conductor pattern applies a drive voltage selectively input via the electrode pads 16 to the conductive plates 1. The conductor pattern is formed by a plurality of conductors provided on the contact substrate 7 and are each electrically connected to the respective conductive plate 1 of the head chip 4 by wire bonding or similar technology. The portions connecting the conductive plates 1 and the conductors are covered and sealed by use of an insulating resin. If desired, the contact substrate 7 may be implemented as a printed circuit board or a flexible printed circuit board adhered to a plate formed of an insulating material.

In summary, it will be seen that the present invention provides a method of producing a record head for an electrostatic ink jet recorder and having various unprecedented advantages, as enumerated below.

(1) A head chip is implemented as a laminate of alternating flat conductors and flat insulators and etched by an etching liquid reactive only to the material of the insulators. As a result, the conductors readily turn out ridges protruding from the head chip and having a high aspect ratio. The ridges each serve as an ejection electrode.

(2) Any desired aspect ratio is achievable by adjusting the duration of etching.

(3) Only by cutting a base into head chips each having corners, can record heads having ink ejection points be produced extremely easily.

Various modifications will become possible for those skilled in the art after receiving the teachings of the present disclosure without departing from the scope thereof.

What is claimed is:

1. A method of producing a record head for an electrostatic ink jet recorder, said method comprising the steps of:

laminating together alternating plates of flat conductors each having a thickness of several tens of microns and flat insulators each having a thickness of several tens of microns, perimeters of the plates collectively forming side surfaces of the head; and etching said insulators by an etching liquid reactive only to said insulators, an entire perimeter of at least one of said flat insulators being etched to a depth measured from the side surfaces, so that the perimeters of said plates of flat conductors extend with respect to the perimeters of said etched plates of flat insulators at the side surfaces of the head.

2. A method as claimed in claim 1, further comprising the step of setting a desired duration of etching using the etching liquid, whereby said perimeters of said at least one flat insulator is etched to a desired depth with respect to the perimeters of said plates of conductors.

3. A method as claimed in claim 1, further comprising the step of cutting a base consisting of said conductors and said insulators laminated alternately to thereby form corners, whereby said corners are used as ejection points for ejecting the ink.

* * * * *